United States Patent [19]

Fortunski et al.

[11] 4,192,615

[45] Mar. 11, 1980

[54] SAND MULLING MACHINE PLOW

[75] Inventors: Anthony C. Fortunski, Grosse Pointe Park; Everett G. Gentry, Grosse Ile, both of Mich.

[73] Assignee: Fargo Machine & Tool Company, Detroit, Mich.

[21] Appl. No.: 14,708

[22] Filed: Feb. 23, 1979

[51] Int. Cl.[2] ..... B01F 7/20

[52] U.S. Cl. ..... 366/65; 366/312; 366/328

[58] Field of Search ..... 366/64, 65, 66, 67, 366/10, 312, 313, 309, 311, 328; 241/110

[56] References Cited

U.S. PATENT DOCUMENTS

| | | | |
|---|---|---|---|
| Re. 28,659 | 12/1975 | Wenninger | 241/110 |
| 2,011,699 | 8/1935 | Amend | 366/313 |
| 3,256,573 | 6/1966 | Hunter | 366/10 |

*Primary Examiner*—Robert W. Jenkins

*Attorney, Agent, or Firm*—Cullen, Sloman, Cantor, Grauer, Scott & Rutherford

[57] ABSTRACT

A plow for use in a sand mulling machine having a vertically axised bowl formed with a bottom wall and a cylindrical peripheral wall, and a rotatable hub upon which the vertically axised mulling rollers are mounted for mulling material against the peripheral wall. The plow comprises an elongated generally flat plate secured to the hub for rotation therewith, and located adjacent the bowl peripheral wall at a sloped angle relative to the bowl bottom wall. One narrow end of the plow forms a leading edge arranged closely adjacent to the bowl bottom wall and the opposite end of the plow forms a rear or trailing edge which is spaced from the bottom wall. The rear or trailing portion of the plow is formed with a number of elongated, spaced apart, narrow, fingers providing a comb-like structure wherein material to be mulled is picked up along the plow leading edge and moves upwardly along the plow body and upon and through the comb-like structure formed on the trailing edge portion of the plow.

4 Claims, 6 Drawing Figures

SAND MULLING MACHINE PLOW

BACKGROUND OF THE INVENTION

The invention herein relates to an improved plow structure for use in a sand mulling machine such as is illustrated and described in U.S. Pat. No. Re. 28,659 issued Dec. 23, 1975 to Wenninger, U.S. Pat. No. 3,666,243 issued May 30, 1972 to Bisinella and U.S. Pat. No. 3,256,573 issued June 21, 1966 to Hunter. Such type of mulling apparatus generally consists of a vertically axised bowl having a bottom wall or floor and a peripheral or side wall which is roughly cylindrical in shape. A vertically arranged, central hub located within the bowl is motor driven for rotation.

Vertically axised rollers are mounted upon the hub for rotation with the hub as well as for independent rotation for thereby mulling sand or sand-like material between the rim of the rollers and the interior surface of the peripheral wall of the bowl.

The sand-like material within the bowl is moved about or circulated and also is directed between the respective mulling rollers and bowl wall by means of plows. Such plows typically consist of a radially directed arm portion which sweeps the sand-like material radially outwardly as the arm rotates around the bowl with the hub to which it is connected. In addition, the outer end of the arm is normally provided with a plate which forms a so-called lift plow or main plow which is sloped so that its leading edge tends to scoop up the sand and lift and direct the sand upwardly within the bowl and into the path of the rollers.

The primary purpose of this equipment is to provide a better moldable sand for use in foundry casting of metals. Thus, the equipment mulls or mixes the sand and the binders, where such are used, and reduces lumpiness in the sand. In some foundry uses, the mulled sand may be further processed in a second piece of equipment for additional lump breaking and for aerating and screening the sand.

The invention of this application is concerned with certain improvements to the lift plow which produces an improvement in the mulling or mixing, lump breaking and aerating action of the mulling machine.

SUMMARY OF INVENTION

The invention herein contemplates forming a trailing edge finger or comb-like structure on the lift or main plow used in a conventional mulling machine. The plow is made of a flat, elongated, narrow metal plate. The plate is mounted within the bowl of the mulling machine with its narrow leading edge adjacent the bottom wall of the bowl and its opposite narrow, trailing edge arranged at a distance above the bowl bottom wall for sloping the plow. The trailing or rear edge portion of the plow is slotted to form a comb-like formation made of elongated, narrow, spaced apart, roughly parallel fingers. These fingers are relatively long so that they form a substantial portion of the trailing portion of the plow plate. Thus, the sand-like material being mulled tends to travel along the upper surface of the plate and also along the fingers, as well as between them, for thereby blending and mixing the sand-like particles along with the additives normally used in sand for foundry casting uses. The action of the fingers, in addition, tends to break up lumps, including shearing lumped material. The structure also tends to aerate the mulled sand and to provide a cooling action.

Sand type mulling machines normally serve to mix or blend foundry sand with additives, such as binders and the like, following which the mixtures are placed within foundry casting flasks. It is necessary to mull rapidly because of production requirements and the mulling action itself should provide uniformly blended material without lumps. Thus, the elongated, sloped plow plate of the invention herein, with its elongated comb-like formation along its trailing portion, tends to improve the mulling and blending operation considerably, behaving like an aerator in operation to produce improved moldability of any given green sand mixture. For some uses, the combing action and the aeration effect is sufficient to eliminate the need for a second piece of aerating or screening equipment.

An object of the invention herein, is to provide an improved plow structure which can be utilized in an existing, conventional mulling machine, without effecting or changing the machine construction, parts or operation and which will considerably improve the mulling action without substantially effecting the power requirements for operating the machine. In essence, the improved plow can be substituted for the pre-existing plow to produce the improved operating results.

These and other objects and advantages of this invention will become apparent upon reading the following description, of which the attached drawings form a part.

DETAILED DESCRIPTION

Figure 1:
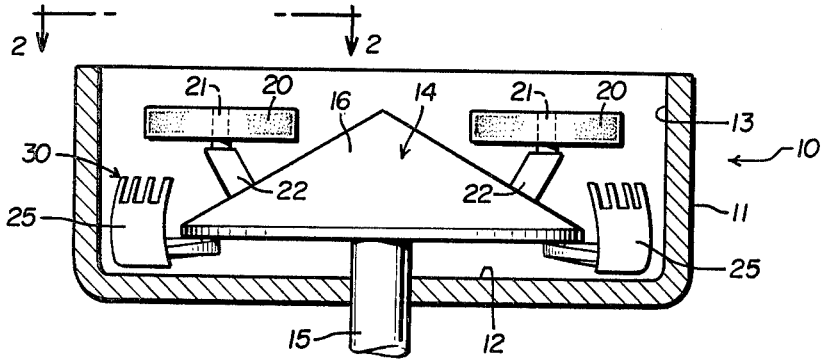
FIG. 1 is a schematic, cross-sectional, elevational view of a conventional mulling machine with the improved plow mounted therein.
Figure 2:
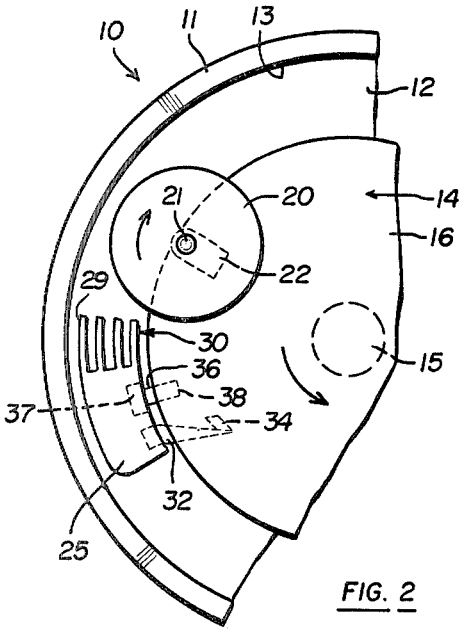
FIG. 2 is a schematic, plan view of a portion of the machine taken in the direction of arrows 2—2 of FIG. 1.

The mulling machine 10 is schematically illustrated in FIGS. 1 and 2 since the structure thereof forms no part of this invention. Its details of construction may vary, but in general, it is contemplated to utilize a machine such as those illustrated in the above identified U.S. Pat. No. Re. 28,659 or U.S. Pat. Nos. 3,666,243 or 3,256,573. Such mulling machines include a vertically arranged mulling bowl 11 which provides a bottom wall or floor 12 and a generally cylindrically shaped side or peripheral wall 13 against which the mulling action takes place.

Sand or sand-like material, plus binders and other additives are dumped into the bowl for mulling and the mulled material is later removed. The means for loading and unloading the bowl is not illustrated as it forms no part of the invention herein, but such means may be similar to that described in the above patents.

The mulling machine includes a hub 14 whose shape may be varied for different mulling purposes but which generally or schematically is formed with a vertically axised drive shaft 15 covered by a dome shaped cover or deflector 16 which is secured to and rotates with the shaft. In this kind of equipment, the lower end of the shaft may be directly driven by an electric motor or more likely, driven through a gear box arrangement or other power transmission means by an electric motor. The drive mechanism forms no part of this invention and therefore is eliminated from this description. However, the drive shaft 15 is rotated at a constant speed and in one rotative direction as is common in mulling machines.

Mulling rollers 20 are mounted upon the hub cover 16. The rollers, which are shown schematically, ordinarily are formed of a wheel which might have a rubber-like tire around it. However, for purposes of disclosure herein, the rollers are illustrated schematically and although two rollers are shown in FIG. 1, the number of rollers may be varied depending upon the size and purpose of the equipment.

The rollers 20 rotate in a horizontal plane. That is, they are vertically axised by being rotatably supported upon vertically arranged axles 21 which are secured to support brackets 22, in turn fastened to the hub so that the rollers rotate with the hub, as well as rotate independently about their own axes. The rotation of the rollers squeezes or mulls the sand-like material between the roller rims and the bowl peripheral wall, as is conventional.

The invention herein relates to the plow structure which is referred to as a main plow or lift plow 25. The plow is formed of an elongated, generally flat, metal plate which is provided with a narrow leading or forward edge 26 and a rear or trailing edge 27. The rear portion of the plate is provided with a number of long, narrow slots 28 to thereby form elongated, narrow, closely adjacent fingers 29 which produce a comb-like structure 30. The leading or forward edge 26 is preferably formed at a chisel-like angle as illustrated in FIG. 3 for better scooping or lifting action.

Figure 3:
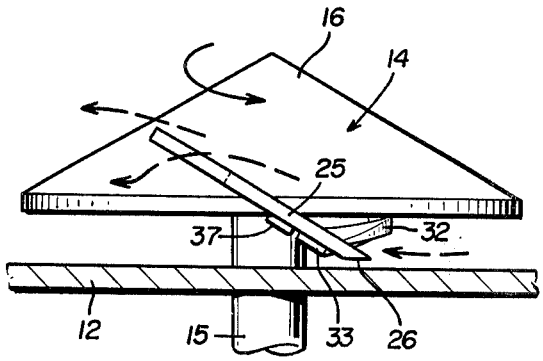
FIG. 3 is a schematic, side elevational view of the hub portion of the mulling machine and improved plow.
Figure 5:
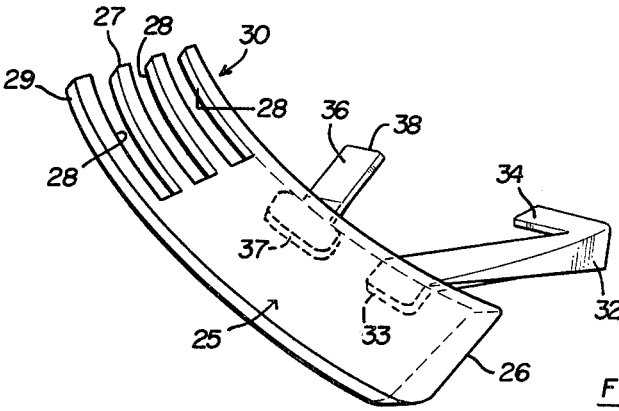
FIG. 5 is a perspective view showing the improved plow and its mounting or support arm and bracket.

The plow is arranged within the bowl adjacent the bowl peripheral wall at a slope or angle relative to the floor or bottom wall 12 of the bowl, as shown in FIGS. 3 and 5. Thus, the plow moves in a circular path adjacent the interior surface of the peripheral wall to lift the sand-like material from the area near the bowl floor upwardly, at an inclined angle, towards the gap between the mulling rollers and bowl wall. The plow movement is indicated by the solid line arrow in FIGS. 2 and 3, and the material movement is indicated by the dotted line arrows in FIG. 3. Likewise the hub and roller movements are indicated by the respective arrows in FIG. 2.

The plow is mounted upon the hub by means of conventionally used brackets and the like. For example, in order to mount the plow in position to direct the sand-like material as mentioned above, the plow is secured to the hub by means of a sweep arm 32 which is roughly radially arranged with its outer end fastened in some conventional manner, such as by welding or by a bracket at 33, to the plow and its inner arm end is likewise conventionally fastened to the hub, as by means of a bracket 34 or welding or the like. The sweep arm is preferably either bent or curved in such a manner as to sweep or direct or plow material from the center parts of the bowl outwardly towards the plow 25 where it may be scooped up and directed upwardly by the plow.

Another bracket 36, which is schematically illustrated, is formed with an outer end portion 37 which is welded or bolted to the plow plate at the middle and rear portion of the plate. The opposite end 38 of the bracket is fastened to the hub. In actual practice, a single bent metal support bracket may be used to fasten both the plow and the sweep arm to the hub cover 16. The details of this construction are omitted here since it forms no part of the invention herein.

Figure 4:
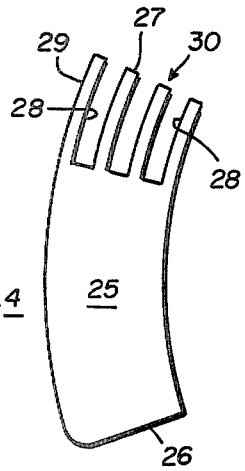
FIG. 4 is a plan view of the plow.

The plow long edges may be curved, as illustrated in FIG. 4, so that such edges may be arranged closer to the bowl wall and hub cover.

The finger or comb-like structure, formed on the plow plate, covers a substantial portion of the rear of the plow, such as about one-third or more of the total length of the plow plate. The number of fingers may vary, such as typically from three to six, and preferably the space between adjacent fingers is wider than the width of the individual fingers. Thus, as the sand-like material is guided or travels upwardly along the sloped surface of the plow (see dotted arrows in FIG. 3), the material in part passes between the fingers, and in part over the fingers. This stirring or combing action tends to blend or mix the sand with the additives or binders, as well as to shear and break up lumpy material and to provide an aerating effect which also helps cool the sand during the mulling action. The speeds of rotation of the plow are generally the same as is conventional and may be adjusted somewhat in practice, in any particular existing mulling machine, to produce optimum effects based upon observation of the action.

The performance and function of this improved plow is not necessarily dependent on the action of the rollers usually used in these mulling machines. The comb-like structure on the trailing edge of the plow will enhance mixing, mulling, aerating and cooling of the material being mixed whether or not rollers are present in the mulling machine.

The improved plow may be made more wear resistant, that is resistant against the abrading action of the sand particles by any of the known techniques, such as by constructing the plow, or portions thereof, of a wear resistant alloy, or by applying onto the plow surfaces and/or edges wear resistant materials such as hard weld, carbide plate, etc., ceramic tile or other suitable wear resistant materials.

Figure 6:
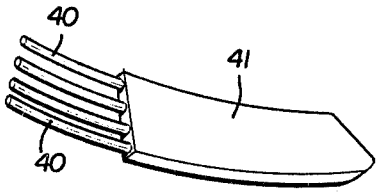
FIG. 6 is a perspective view of a modification.

FIG. 6 illustrates a modification, wherein the fingers 40 are each formed of a separate rod-like member which may be made of hardened metal material. The fingers may be welded, at their ends, to the rear edge of a shortened metal plow plate 41. The fingers may be approximately circular in cross-section, or of some other rounded or curved cross-sectional shape.

The number of plows used in the mulling machine may vary, with some machines using as many as four, and others using, for example, only two. However, regardless of the number of plows used, the plow construction herein should significantly improve the operation of the equipment.

The invention herein may be developed further within the scope of the attached claims. Therefore, having fully described an operative embodiment of this invention, we now claim:

1. In a mulling plow for use in a sand mulling machine having a vertically axised mulling bowl with a bottom wall and a generally cylindrical shaped peripheral wall and a vertically axised, central, rotatable hub, with the plow being formed as a generally flat, elongated plate spaced away from, but secured to the hub for rotation therewith, with the plate located adjacent the peripheral wall and being sloped along its longer length dimension relative to the bottom wall, so that its leading length edge, i.e., its narrower edge which leads in the direction of rotation, is close to the bottom wall, and its opposite trailing, edge is spaced a distance above the bottom wall, wherein the plow rotates in a circular path adjacent the peripheral wall and lifts and directs the sand material being mulled upwardly from the bowl bottom wall, that is, from the leading edge, and in an upwardly sloped direction along the upper, elongated surface of the plate and across the trailing edge, the improvement comprising:

the plow trailing edge portion being formed in the shape of a number of spaced apart, narrow, elongated, roughly parallel fingers extending from the trailing edge approximately one-third the length dimension of said plow plate towards the leading edge of the plate to form the rear portion of the plow in a comb-like configuration;

said spaced apart fingers providing spaces between adjacent fingers such that the sand material is lifted upwardly along the sloped surface of said plow plate, the material in part passes between said fingers and in part over the fingers and said material is thereby subjected to a combing-like action as it passes along and leaves the trailing portion of the plate to blend and mix the sand material.

2. A mulling machine lift plow formed of an elongated plate having a narrow leading edge and an opposite narrow trailing edge, for mounting within the bowl of a vertically axised sand-type mulling machine and for rotation around the central axis of the bowl, near the peripheral wall thereof, with the plate arranged so that the leading edge thereof is nearer to the bowl bottom for lifting and directing material to be mulled in a direction upwardly from the bowl bottom;

said plow having its trailing edge portion formed in a comb-like structure comprising a number of narrow, elongated, roughly parallel, spaced apart fingers which extend from the trailing edge approximately one-third the length dimension of said plow towards the leading edge along the trailing portion of the plate;

said spaced apart fingers providing spaces between adjacent fingers such that the material is lifted in an upwardly sloped direction along the upper face of the plow and then is subjected to a combing-like action wherein the material in part passes between said fingers and in part over the fingers.

3. A construction as defined in claim 2 above, and wherein a number of elongated, relatively wide, roughly parallel slots are formed in the plate and extend from the plate trailing edge towards the plate leading edge, and wherein the slots are wider than the width of the individual fingers.

4. A construction as defined in claim 2 and said fingers comprising elongated rod-like members arranged generally in the plane of the plate with one end of each member being joined to the plate and the opposite ends of all of the members defining the plate trailing edge.

* * * * *